US006750386B2

(12) United States Patent
King

(10) Patent No.: US 6,750,386 B2
(45) Date of Patent: Jun. 15, 2004

(54) CYCLE OF FIFTHS STEEL PAN

(76) Inventor: Trevor King, 133-23 161 St., Jamaica, NY (US) 11434

( * ) Notice: Subject to any disclaimer, the term of this patent is extended or adjusted under 35 U.S.C. 154(b) by 0 days.

(21) Appl. No.: 10/228,317

(22) Filed: Aug. 26, 2002

(65) Prior Publication Data

US 2004/0035283 A1 Feb. 26, 2004

(51) Int. Cl.[7] ..... G10D 13/02
(52) U.S. Cl. ..... 84/411 R
(58) Field of Search ..... 84/411 R, 419, 84/420

(56) References Cited

U.S. PATENT DOCUMENTS

| | | | | |
|---|---|---|---|---|
| 4,214,504 A | | 7/1980 | Rex | 84/411 |
| 4,271,745 A | | 6/1981 | Shatto | 84/462 |
| 4,858,510 A | | 8/1989 | Shimoda et al. | 84/402 |
| 5,686,679 A | | 11/1997 | Nakano et al. | 84/402 |
| 5,814,747 A | | 9/1998 | Ramsell | 84/402 |
| 5,973,247 A | * | 10/1999 | Matthews | 84/402 |
| 6,198,033 B1 | | 3/2001 | Lovelett | 84/411 |
| 6,212,772 B1 | * | 4/2001 | Whitmyre et al. | 29/896.22 |
| 6,268,557 B1 | | 7/2001 | Devecka | 84/477 |

* cited by examiner

*Primary Examiner*—Kimberly Lockett

(57) ABSTRACT

An instrument with a previously-determined quantity of tones, which interpret a desired musical scale or chords. Importantly, the tones are arranged in a fifth dimension frequency, (i.e. D-A-E-B-F#, etc.) providing a "cycle of fifths" pattern for the convenience of the user. In the preferred mode, the device is a steel drum with unique tones in a 360 degree circumference. Engraved steadfast notes are arranged in a circular or clock-like pattern, with a visual pattern guide on the surface thereof, allowing the user to strike the tones to achieve the fifth dimension frequency. Therefore, the invention uniquely allows for playing of the instrument with considerably less challenge to the player's mental comprehension.

3 Claims, 1 Drawing Sheet

CYCLE OF FIFTHS STEEL PAN

BACKGROUND OF THE INVENTION

1. Field of the Invention

Figure 1:
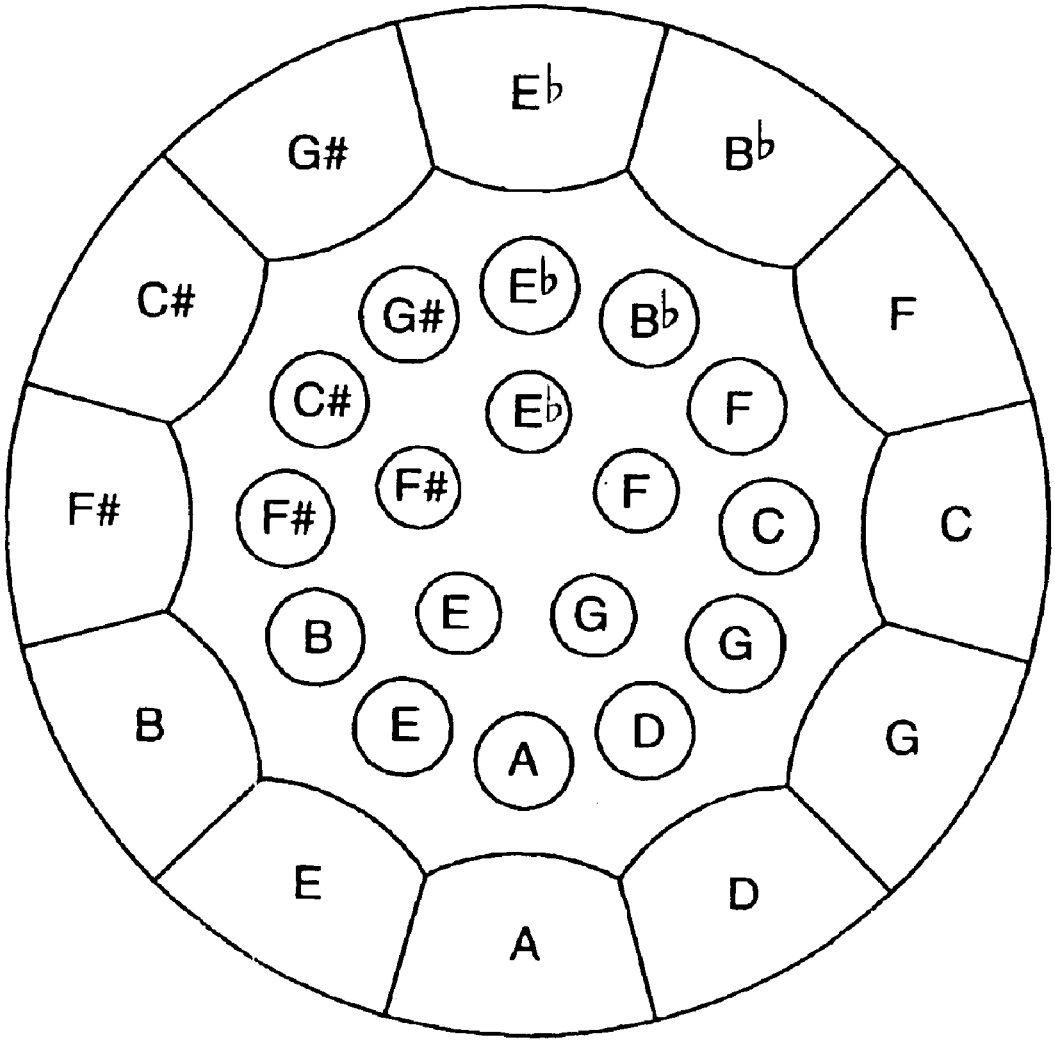
Figure 1:
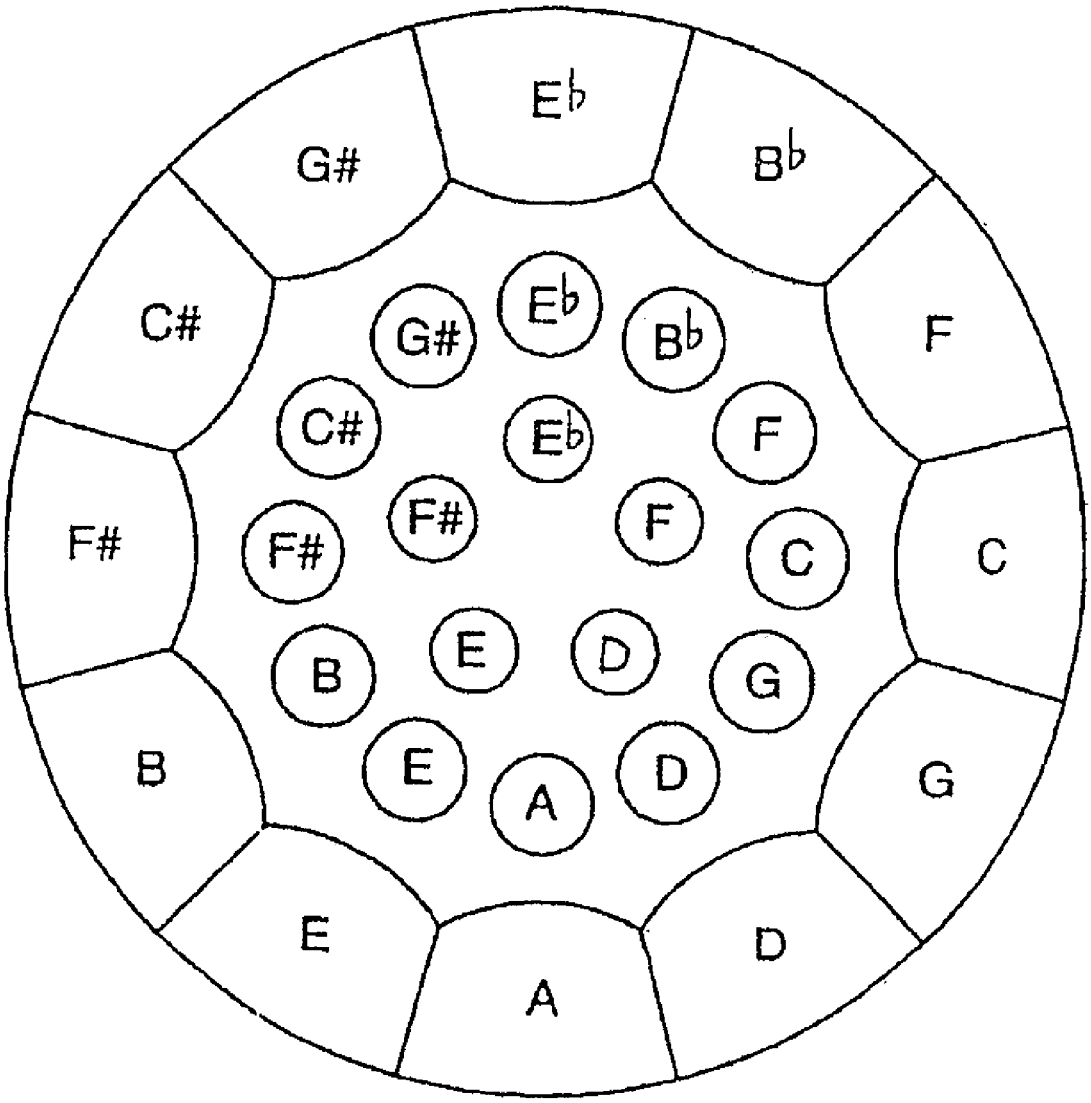

The present invention is a music-related device. More particularly, the device is an instrument with a previously-determined quantity of tones, which interpret a desired musical scale or chords. Importantly, the tones are arranged in a fifth dimension frequency, (i.e. D-A-E-B-F#, etc.) providing a "cycle of fifths" pattern for the convenience of the user.

In the preferred mode, the device is a steel drum with unique tones in a 360 degree circumference. Engraved steadfast notes are arranged in a circular or clock-like pattern, with a visual pattern guide on the surface thereof, allowing the user to strike the tones to achieve the fifth dimension frequency. Therefore, the invention uniquely allows for playing of the instrument with considerably less challenge to the player's mental comprehension.

2. Description of the Prior Art

Numerous innovations for musical drum devices have been provided in the prior art that are described as follows. Even though these innovations may be suitable for the specific individual purposes to which they address, they differ from the present invention as hereinafter contrasted. The following is a summary of those prior art patents most relevant to the invention at hand, as well a description outlining the differences between the features of the present invention and those of the prior art.

1. U.S. Pat. No. 5,973,247, Invented by Matthews, Entitled "Portable Steel Drums and Carrier"

The patent to Matthews describes a portable steel drum assembly for use in a marching band which includes a first steel drum having a defined playing surface including a first set of predefined indentations defining a first set of notes and a second steel drum having a defined playing surface including a second set of predefined indentations defining a second set of notes. The first and second steel drums each have a diameter less than twenty-two inches providing the steel drum assembly with sufficient lightweightness and compactness enabling a musician to perform the steel drum assembly while carrying the steel drum assembly. A steel drum carrier including a harness and a steel drum mount enables a musician to carry the first and second steel drums.

2. U.S. Pat. No. 4,214,504 Invented by Rex, Entitled "Compound Drum"

The patent to Rex describes a musical instrument, preferably a compound drum, is provided having a plurality of distinct percussion chambers which may be contiguously incorporated into a single drum shell under a single continuous drum head, wherein this head may include a plurality of distinct surfaces.

3. U.S. Pat. No. 5,814,747, Invented by Ramsell, Entitled "Percussion Instrument Capable of Producing a Musical Tone"

The patent to Ramsell describes a percussion instrument made of durable synthetic tubing which is longitudinally rigid and radially flexible. The tubes are precisely tunable to specific musical pitches through combining proper diameters and lengths of the tubes. The sound is produced primarily by vibration of the column of air within and exiting the tube, which results from striking the tube with an object such as a mallet or from striking another object, including the human body, with the tube The nature of the sound produced varies greatly with the resonant and textural qualities of the struck object. Accordingly, multi-textured percussion blocks are provided for striking with the tubes. In addition, a cap is provided for the end of the tube which will lower its pitch about one octave and which, when combined with a second cap, will create a cavity in which pellets, such as steel shot or dried beans, may be placed to produce a rattle.

4. U.S. Pat. No. 5,686,679, Invented by Nakano et al., Entitled "Percussion Instrument with Tone Bars for Exactly Generating Tones on a Scale"

In the patent to Nakano et al., a plurality of metal bars of a vibraphone are regulated such that the first-order to third-order vibration approximate to the frequency ratio of 1:4:8 by using recesses formed in the central portion of the metal bar and the end portions on both sides of the central portion, and a player can make the metal bars generate tones exactly on a scale so as to harmonize with one another.

5. U.S. Pat. No. 6,198,033, Invented by Lovelett, Entitled "Variable Pitch Percussion Instruments"

The patent to Lovelett describes a variable pitch musical drum comprising at least one drumhead the pitch of which can be varied while the drum is being played by varying the volume of air inside the drum, by varying the rate of air flow into or out of the drum, or by a combination of these two principles.

6. U.S. Pat. No. 4,858,510, Invented by Shimoda et al., Entitled "Resonant Musical Instruments"

In the patent to Schimoda et al., a musical instrument such as a jingle, a tambourine or a tomtom is provided with two or more hollow resonators arranged in the vicinity of at least one tone generator such as a pair of jingle discs or a head and preferably selectively closable by means of a slider coupled movably to the body of the instrument. Presence of a plurality of resonators, preferably different in resonance characteristics, assures colorful and rich resonance of tones generated by the tone generator and use of the slider enables easy and free finger control on the mode of resonance.

7. U.S. Pat. No. 6,268,557, Invented by Devecka, Entitled "Methods and Apparatus for Providing and Interactive Musical Game"

In the patent to Devecka an interactive electronic drum system and training techniques suitable for use in a coin-operated environment such as an arcade are described. Electronic drum pads, audio speakers, a visual display, training lights and an overall control system are combined to simulate the excitement of a live drum or interactive musical jam session for a user. Positive feedback and, as necessary, instructive aid are provided to make the experience a positive one for both the novice and the expert player. Learning and playing a musical instrument becomes an intuitive, exciting experience and not a boring chore to be endured. Players can simulate the experience of playing in a rock band before a live and appreciative audience. In short, this interactive electronic drum system makes drums and the jamming experience widely accessible to the public.

8. U.S. Pat. No. 4,271,745, Invented by Shatto, Entitled "Percussion Instruments"

The patent to Shatto describes an instrument that is adjusted to provide well-known cymbal and snare drum tones, as well as other tones which may be a combination or variation of such tones. The instrument comprises a tubular casing of rigid material, having one end supported on a base and its opposite end open. A thin metal diaphragm overlies the open end of the casing with its peripheral portion in overhanging relation. Means are provided to support the diaphragm intermediate its peripheral portion, and means are provided to hold the diaphragm against the rim of the easing to provide snare drum tones, or to hold the diaphragm spaced from the casing to provide cymbal tones.

Generally, the prior patents illustrate various drums and percussion devices, including: portable steel drums with fixed tones that are not in a cycle of fifth orientation; compound drums with distinct percussion chambers; several variable pitch drum devices; and electric drums with previously-determined tones.

Unlike the above, the present invention is an instrument with tones arranged in a fifth dimension frequency, providing a "cycle of fifths" pattern for the convenience of the user. The steel drum has engraved tones in a circular pattern, with a visual pattern guide on the surface, which allows the player to strike the tones in the fifth dimension frequency with less challenge to the player's mental comprehension.

SUMMARY OF THE INVENTION

As noted, the present invention is an instrument with a previously-determined quantity of tones, which interpret a desired musical scale or chords. Importantly, the tones are arranged in a fifth dimension frequency, (i.e. D-A-E-B-F#, etc.) providing a "cycle of fifths" pattern for the convenience of the user. In the preferred mode, the device is a steel drum with unique tones in a 360 degree circumference. Engraved steadfast notes are arranged in a circular or clock-like pattern, with a visual pattern guide on the surface thereof, allowing the user to strike the tones to achieve the fifth dimension frequency. Therefore, the invention uniquely allows for playing of the instrument with considerably less challenge to the player's mental comprehension.

In light of the foregoing, it is generally an object of the present invention to provide an instrument that allows for convenient teaching and learning of music theory and the inter-relationship of chords and keys.

It is also an object of the invention to provide an instrument that provides unique tonal qualities that enhance the experience of playing and learning from same.

It is a further object of the invention to provide an item that may be constructed of a variety of materials suitable to accomplish the aforementioned purposes.

It is an additional object of the invention to provide an item that may be produced in a variety of sizes.

Finally, it is an object of the present invention to provide an item that may bear indicia or decorative elements therein, in order to enhance the overall appearance of the instrument.

The novel features which are considered characteristic for the invention are set forth in the claims. The invention itself, both as to its construction and its method of operation, together with additional objects and advantages thereof, will be best understood from the following description of the embodiments when read and understood in connection with accompanying drawings.

BRIEF DESCRIPTION OF PREFERRED EMBODIMENTS

FIG. 1 is a front perspective view of the present invention, illustrating the principal components of the drum and the general location of same.

DETAILED DESCRIPTION OF THE PREFERRED EMBODIMENT

Referring to FIG. 1, which is a front perspective view of the present invention: as shown for the purposes of example, a series of musical instruments are bonded in a 360 circumference. Specifically, the configuration comprises an engraved plurality of steadfast notes that are arranged in a unique circular "clock-like" pattern. Pattern guides upon the device exhibit a unique quantity of selected tones which interpret a desired musical scale or chords subsequent to a fifth dimension frequency on the instrument. This generally permits play of the instrument with less challenges to the student's or musician's mental comprehension, due to the usage and display of the "circle of fifths."

The structure of the present invention is called the circle of fifths because as one travels in a clockwise direction, each section increases by an interval of one fifth, or seven half-tones. For the purposes of example, the fifth note of the C major scale is G (immediately following C on the circle) and the fifth note of the G major scale is D (immediately following G on the circle). Thus, the pitches are arranged in such a manner that any two adjacent pitches comprises an interval of a perfect fifth.

The circle consists of an outer section containing a total of twelve notes, representing all available half-tones. Because the configuration is similar to that of numbers on a clock, the circle is easy for the user to read and understand.

Because the circle of fifths assists in indicating the number of sharps or flats that are present, it greatly assists the student in finding out the particular key of a song or arrangement. Importantly, the circle of fifths, and therefore the present invention, can also be used to assist the student in learning chords and chord structure. This is because the circle provides a relatively broad view of the notes and the inter-relationships between them.

In addition, the circle can effectively demonstrate the relationship between different keys, again benefiting the student. As the user proceeds in the clockwise direction, the number of sharps in each key increases by one. Likewise, as the user moves counterclockwise, the number of flats in each key increases by one.

Furthermore the present invention may feature the major keys along outer perimeter, and the minor keys towards the interior of steel pan, again illustrating the relationships between same. The present invention is also very helpful to the student in that it allows the musician to learn common arrangements of popular music styles very easily. For instance, in many styles of music the "tonic" (or first chord of the key in question), the "dominant" (or fifth chord of the key in question), and "subdominant" (or fourth chord of the key in question) are used very prominently. The user of the present invention has the ability to learn the difference in pitch between the first and fifth very easily, as the two pitches adjoin each other on the circle with the fifth note immediately to the right of the first note. Similarly, the user of the present invention has the ability to learn the difference in pitch between the first and fourth very easily, as the two pitches adjoin each other on the circle with the fourth note immediately to the left of the first note.

Next, the present invention also allows the user to conveniently learn the location and sound of the "relative minor" to each major key. For the purposes of example, the user can easily remember the relationship between each major and relative minor in that the relative minor appears three sections to the right (or clockwise) from the major key in question. As an example of same, the relative minor of C is A minor, and the relative minor of G is E minor, as is easy to see on the circle. Therefore, by first using the present invention, the student can check each major and minor. Through repetition and the unique visual and tonic aspects of the invention, the student will memorize the majors and relative minors in due course, benefiting their total understanding of music theory and hence their overall ability as musicians.

With regards to all descriptions and graphics, while the invention has been illustrated and described as embodied, it is not intended to be limited to the details shown, since it will be understood that various omissions, modifications, substitutions and changes in the forms and details of the device illustrated in its operation can be made by those skilled in the art without departing in any way from the spirit of the invention.

Without further analysis, the foregoing will so fully reveal the gist of the present invention that others can readily adapt it for various applications without omitting features that, from the standpoint of pior art, constitute essential characteristics of the generic or specific aspects of this invention. What is claimed as new and desired to be protected by Letters Patent is set forth in the appended claims.

What is claimed is:

1. A cycle of fifths steel pan device comprising:

a first series of musical instruments bonded in a 360 degree circumference, consisting of twelve primary notes arranged in a clockwise pattern creating an outer circumference of the device, the twelve primary notes arranged in a pattern of D-A-E-B-F#-C#-G#-Eb-Bb F-C-G, the twelve primary notes generally large and semi-circular in shape, a second series of musical instruments bonded in a 360 degree circumference, consisting of twelve octave notes to the twelve primary notes arranged in a clockwise pattern creating a middle circumference of the device, the twelve octave notes arranged in a pattern of D-A-E-B-F#-C#-G#-Eb-Bb F-C-G, the twelve octave notes generally circular in shape, and of a smaller size than the twelve primary notes, functioning to create higher octave tones, a third series of musical instruments bonded in a 360 degree circumference, consisting of five higher octave notes arranged in a clockwise pattern creating an inner circumference of the device, the five higher octave notes arranged in a pattern of G-E-F#-Eb-F, the five higher octave notes generally circular in shape, and of a smaller size than the twelve octave notes, functioning to create highest octave tones, the device further comprising a pattern guide on an exterior surface thereof, the pattern guide exhibiting the primary tones, octave tones, and higher octave tones in a cycle of fifths pattern, allowing the user to strike the notes to achieve a desired music scale and/or chords, and further allowing for musical instruction and playing of the instrument with less challenge to mental comprehension of a player.

2. The cycle of fifths steel pan device as described in claim 1, wherein the device further includes indicia upon the surface thereof.

3. The cycle of fifths steel pan device as described in claim 1, wherein the device is of a variety selected from the group consisting of soprano, tenor, alto and bass.

* * * * *

UNITED STATES PATENT AND TRADEMARK OFFICE

CERTIFICATE OF CORRECTION

PATENT NO. : 6,750,386 B2
APPLICATION NO. : 10/228317
DATED : June 15, 2004
INVENTOR(S) : Trevor King It is certified that error appears in the above-identified patent and that said Letters Patent is hereby corrected as shown below:

The title page showing an illustrative figure(s) 1 should be deleted and substitute therefore the attached title page consisting of Fig. 1.

The drawing sheet consisting of Fig(s) 1 should be deleted and substitute therefore the attached drawing sheet consisting of Fig(s) 1.

On the drawing, the "G" not in the third series of notes should be a "D" note. See Fig. 1.

Col 6, line 6-13, claim 1 should read

> a third series of musical instruments bonded in a 360 degree circumference, consisting of five higher octave notes arranged in a clockwise pattern creating an inner circumference of the device, the five higher octave notes arranged in a pattern of D - E - F#-Eb - F, the five higher octave notes generally circular in shape, and of a smaller size than the twelve octave notes, functioning to create highest octave tones, Signed and Sealed this Eighteenth Day of December, 2007

JON W. DUDAS
*Director of the United States Patent and Trademark Office*

(12) United States Patent
King

(10) Patent No.: US 6,750,386 B2
(45) Date of Patent: Jun. 15, 2004

(54) CYCLE OF FIFTHS STEEL PAN

(76) Inventor: Trevor King, 133-23 161 St., Jamaica, NY (US) 11434

( * ) Notice: Subject to any disclaimer, the term of this patent is extended or adjusted under 35 U.S.C. 154(b) by 0 days.

(21) Appl. No.: 10/228,317

(22) Filed: Aug. 26, 2002

(65) Prior Publication Data

US 2004/0035283 A1 Feb. 26, 2004

(51) Int. Cl.[7] ..... G10D 13/02
(52) U.S. Cl. ..... 84/411 R
(58) Field of Search ..... 84/411 R, 419, 84/420

(56) References Cited

U.S. PATENT DOCUMENTS

| | | | | |
|---|---|---|---|---|
| 4,214,504 | A | 7/1980 | Rex | 84/411 |
| 4,271,745 | A | 6/1981 | Shatto | 84/462 |
| 4,858,510 | A | 8/1989 | Shimoda et al. | 84/402 |
| 5,686,679 | A | 11/1997 | Nakano et al. | 84/402 |
| 5,814,747 | A | 9/1998 | Russell | 84/402 |
| 5,973,247 | A * | 10/1999 | Matthews | 84/402 |
| 6,198,033 | B1 | 3/2001 | Lovelett | 84/411 |
| 6,212,772 | B1 * | 4/2001 | Whitmyre et al. | 29/896.22 |
| 6,268,557 | B1 | 7/2001 | Dewecke | 84/477 |

* cited by examiner

*Primary Examiner*—Kimberly Lockett

(57) ABSTRACT

An instrument with a previously-determined quantity of tones, which interpret a desired musical scale or chords. Importantly, the tones are arranged in a fifth dimension frequency, (i.e. D-A-E-B-F#, etc.) providing a "cycle of fifths" pattern for the convenience of the user. In the preferred mode, the device is a steel drum with unique tones in a 360 degree circumference. Engraved steadfast notes are arranged in a circular or clock-like pattern, with a visual pattern guide on the surface thereof, allowing the user to strike the tones to achieve the fifth dimension frequency. Therefore, the invention uniquely allows for playing of the instrument with considerably less challenge to the player's mental comprehension.

3 Claims, 1 Drawing Sheet

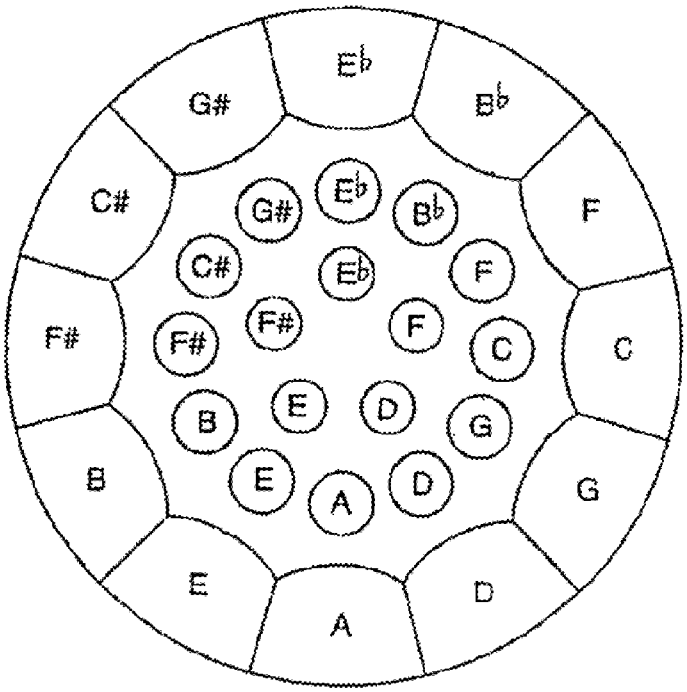

US006750386C1

(12) INTER PARTES REEXAMINATION CERTIFICATE (594th)

United States Patent

King

(10) Number: US 6,750,386 C1

(45) Certificate Issued: May 3, 2013

(54) CYCLE OF FIFTHS STEEL PANS

(76) Inventor: Trevor King, Jamaica, NY (US)

Reexamination Request:
No. 95/000,255, Jul. 20, 2007

Reexamination Certificate for:

| | |
|---|---|
| Patent No.: | **6,750,386** |
| Issued: | **Jun. 15, 2004** |
| Appl. No.: | **10/228,317** |
| Filed: | **Aug. 26, 2002** |

Certificate of Correction issued Dec. 18, 2007

(51) Int. Cl.
*G10D 13/02* (2006.01)
*G10D 13/00* (2006.01)

(52) U.S. Cl.
USPC ..... 84/411 R

(58) Field of Classification Search
None
See application file for complete search history.

(56) References Cited

To view the complete listing of prior art documents cited during the proceeding for Reexamination Control Number 95/000,255, please refer to the USPTO's public Patent Application Information Retrieval (PAIR) system under the Display References tab.

*Primary Examiner* — Ovidio Escalante

(57) ABSTRACT

An instrument with a previously-determined quantity of tones, which interpret a desired musical scale or chords. Importantly, the tones are arranged to a fifth dimension frequency, (i.e. D-A-E-B-F#, etc.) providing a "cycle of fifths" pattern for the convenience of the user. In the preferred mode, the device is a steel drum with unique tones in a 360 degree circumference. Engraved steadfast notes are arranged in a circular or clock-like pattern, with a visual pattern guide on the surface thereof, allowing the user to strike the tones to achieve the fifth dimension frequency. Therefore, the invention uniquely allows for playing of the instrument with considerably less challenge to the player's mental comprehension.

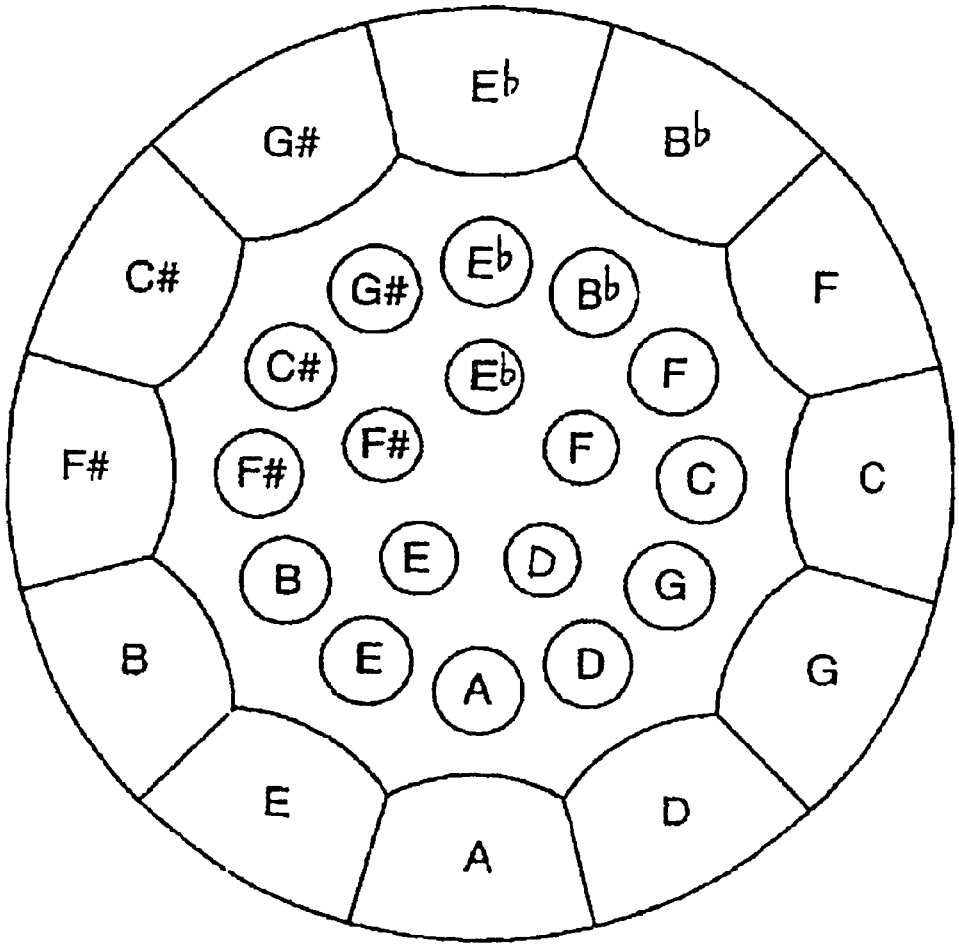

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

Claims 1-3 are cancelled.

* * * * *